United States Patent [19]

Stephansen

[11] Patent Number: 4,509,270

[45] Date of Patent: Apr. 9, 1985

[54] METHOD AND APPARATUS FOR DRYING A MOVING WEB

[75] Inventor: Erik Stephansen, Hillsborough, Calif.

[73] Assignee: Impact Systems, Inc., San Jose, Calif.

[21] Appl. No.: 498,298

[22] Filed: May 26, 1983

[51] Int. Cl.[3] ..... F26B 3/28

[52] U.S. Cl. ..... 34/4; 34/41; 34/48; 250/494.1; 250/498.1

[58] Field of Search ..... 34/4, 39, 41, 48, 49; 250/494.1, 495.1, 504 R, 492.1, 498.1

[56] References Cited

U.S. PATENT DOCUMENTS

| | | | |
|---|---|---|---|
| 2,565,570 | 8/1951 | Messinger | 34/41 |
| 3,406,954 | 10/1968 | Fannon, Jr. | 432/41 |
| 3,793,741 | 2/1974 | Smith, Jr. | 34/48 |
| 3,864,546 | 2/1975 | Cahnman et al. | 34/48 |
| 3,894,343 | 7/1975 | Pray et al. | 34/41 |
| 4,015,340 | 4/1977 | Treleven | 34/41 |

*Primary Examiner*—Larry I. Schwartz

*Attorney, Agent, or Firm*—Flehr, Hohbach, Test, Albritton & Herbert

[57] ABSTRACT

A cross-direction web dryer includes a support structure arranged transversely across the moving web consisting of a pair of elongated support members each carrying side-by-side heater modules facing the moving web. This pair of structural members may be moved from the above operating position by a rotating and pivoting action to a stowed position where the heater elements are juxtaposed and co-extensive with one another to effectively thermally capture the heat of the heater elements. This reduces the heating up of the surrounding area while the heater elements cool down and prevents paper scrap and other flammable products from igniting that could create a fire hazard.

11 Claims, 8 Drawing Figures

METHOD AND APPARATUS FOR DRYING A MOVING WEB

The present invention relates to an apparatus and method therefor for drying a moving web and more particularly to radiant heaters located in the cross-direction of the moving web which may be individually controlled to provide an even moisture profile.

A co-pending application entitled APPARATUS FOR DRYING A MOVING WEB, filed June 7, 1982, Ser. No. 385,688, now abandoned, in the names of Erik Stephansen, Rajeeva Sharma and Michael Richie, discloses a process where a continuously moving sheet of paper is being produced and it is desired to efficiently correct variation of moisture content across a web of paper. Thus, that application shows a web dryer which has a main structural support member on which is mounted cantilevered heating or drying modules. The entire structure is supported at both ends, that is, it is pivotally mounted, so that it can be rotated away from the moving web when desired. The structural member of this dryer also provides an electrical wireway or conduit for the power cables to the individual dryer modules.

Where relatively high temperatures are present, because of the dryer modules, there is a fire hazard problem. For example, with a break in the paper web, paper scrap may be present which is flammable. One way of eliminating this problem is, of course, as illustrated in the above-mentioned application, of pivoting away from the web or sheet material. U.S. Pat. No. 3,864,546 to Cahnman et al. also suggests pivoting heaters away from a moving web and in addition provides a perpendicular heat shield extending from the back of each of the heating panels in such a manner as to engage the adjoining panel to prevent any radiation from falling on the web. Thus, this is a type of shutter.

A technique for preventing damage to a stopped web is shown in the U.S. Pat. No. 3,406,954 in the name of J. J. Fannon, Jr. entitled APPARATUS FOR WEB DRYING. There when motion of the web ceases the heating modules, which are mounted on trolleys, are rapidly retracted from the web as illustrated in its FIG. 1. And, thereafter, a stream of cooling air is provided.

The foregoing techniques are sometimes mechanically cumbersome, may require excessive installation space and may not be fully effective or rapid enough.

Thus, it is an object of the present invention to provide an improved apparatus and method therefor for drying a moving web.

In accordance with the above object, there is provided a method of drying a moving web comprising the steps of providing across the transverse cross-direction of the web a pair of elongated dryer units each extending from one edge of the web to the other and each facing the web and being in close proximity to it to dry it. The pair of dryer units is moved to a storage position in which the drying elements of the units which were formerly facing the web are now closely juxtaposed and co-extensive with each other to capture and prevent any infrared radiation escaping to the surrounding area and to prevent direct radiation to other surfaces to minimize fire hazards.

From an apparatus standpoint, apparatus for drying a web comprises a pair of elongated structural members having a length at least as great as the web in transverse cross-direction and carrying a plurality of side-by-side heater modules for drying the web. Means are provided for moving the pair of members from an operation position, where heating elements contained in each of the heater modules are facing and in close proximity to the web to dry such web, to a stowed position where the pair of members are folded together so that the heating elements are closely juxtaposed and co-extensive with each other.

Figure 1:
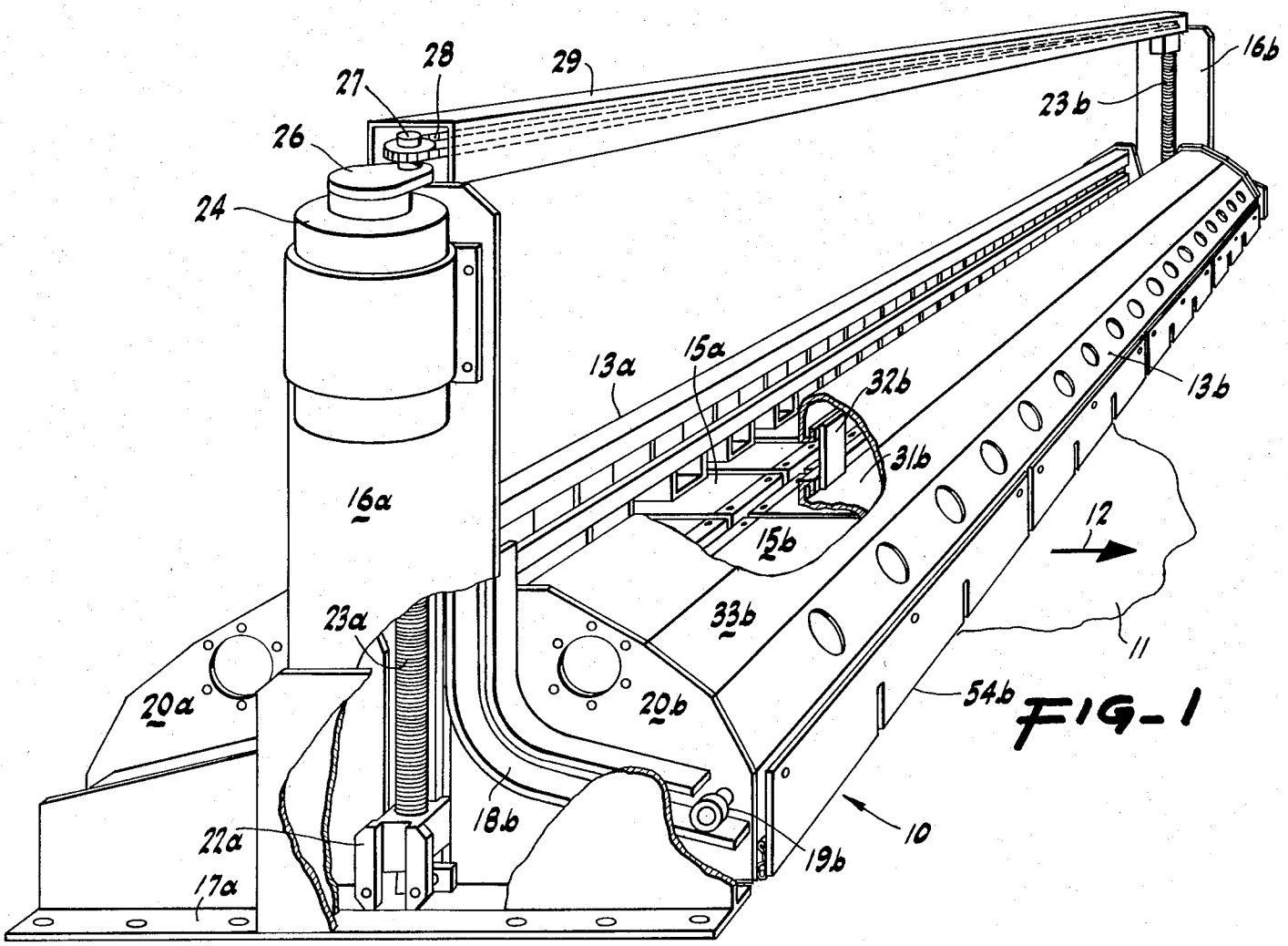
FIG. 1 is a perspective view of apparatus embodying the present invention showing it in an operating position drying a sheet of moving paper.

FIG. 1 shows the drying apparatus 10 embodying the present invention which is located transverse or in the cross-direction to the moving paper sheet 11 having a direction of motion indicated by the arrow 12. In the position shown, the dryer units contained within the apparatus are in very close proximity to the moving web 11.

Figure 4:
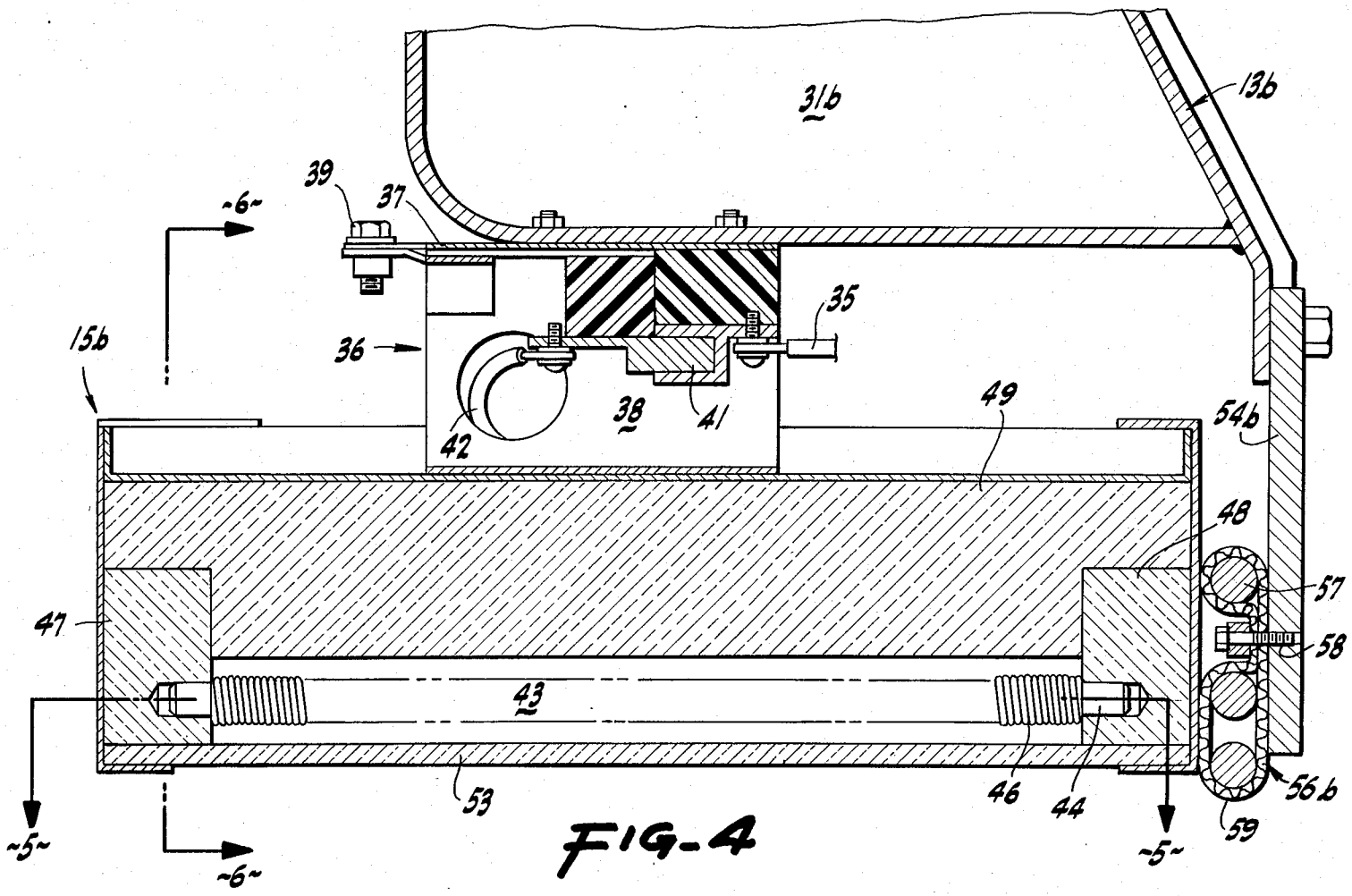
FIG. 4 is an enlarged partial cross-sectional view of a portion of FIG. 1 showing in detail a heater module.

As discussed in a co-pending Ostrow et al. application, now abandoned, entitled CROSS-DIRECTION WEB DRYER, filed July 6, 1982, Ser. No. 395,864, the dryer has several individually controlled heater modules which are in a side-by-side relationship across the paper to allow for individual zones or slices of the paper to be dried to individual specifications, In the present invention, there are a pair of elongated structural members **13*a* and 13*b* both of which contain or carry a plurality of side-by-side heater modules for drying the web 11. As illustrated in FIG. 1, the structural members 13*a*, 13*b* are in an operating position where the heating elements contained in each of the individual heater modules are facing and in close proximity to the web 11 to dry it. As will be discussed below, FIG. 4 shows one of these modules 15*b* which is suspended from the frame or structural member 13*b***.

Figure 2:
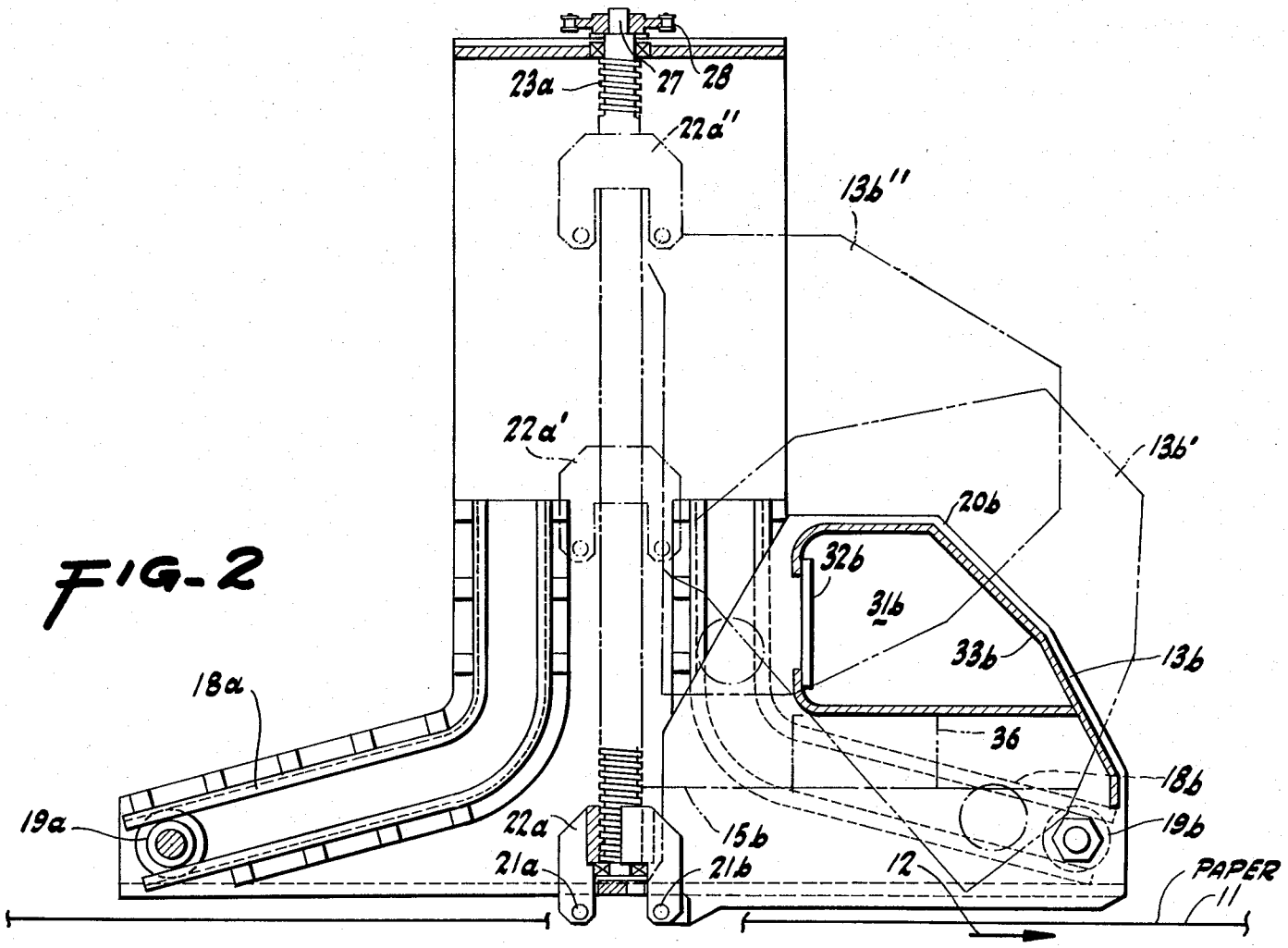
FIG. 2 is an enlarged cross-sectional view of FIG. 1 also illustrating in phantom movement to a stowed position.
Figure 7:
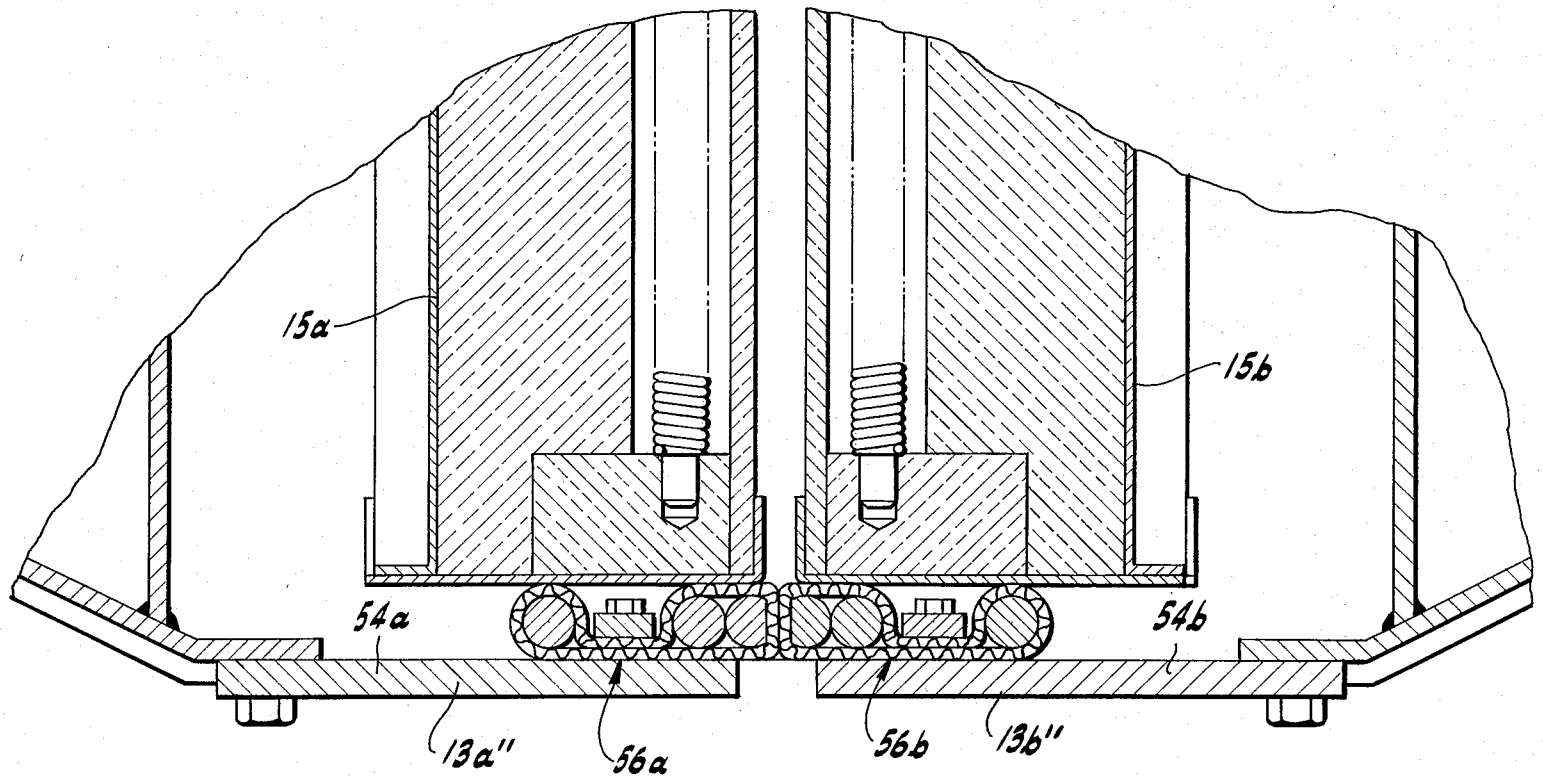
FIG. 7 is an enlarged cut-away cross-sectional view of heater modules in their stowed position.

Now still referring to FIG. 1, the structural members **13*a* and 13*b* are supported at each end by a pair of fixed support means 16*a*, 16*b*. These support means would be mounted on a convenient structure associated with the paper making machine and in a desired location on the machine. A mounting bracket is shown as 17*a*. The end supports 16*a*, 16*b* both retain the pair of structural members 13*a*, 13*b* and allow them to move in a sliding and pivoting manner from the operating position shown in FIG. 1 to a stowed position. This is illustrated in FIG. 2 where 13*b*″ is shown in phantom. The left half of the drying apparatus 13*a* is moved similarly so that the pair of structural members are in essence folded together with their heating elements facing each other as illustrated in FIG. 7**.

Now referring to both FIGS. 1 and 2 and the details of the end support members **16*a* and 16*b*, these include a pair of tracks 18*a*, 18*b* in which end portions 19*a*, 19*b*** of each elongated structural member 13a, 13b are movable and slidable and pivotable. In fact, as best shown in FIG. 1, this is a roller on a shaft extending from an end plate 20b on member 13b. An opposite portion of the end plates 20a, 20b are pinned by pins 21a, 21b to nut 22 which is threaded on a raising screw 23a. The identical screw structure 23b is at the other end also. Screw 23a is rotated by a motor 24 which is coupled at 26 to the end 27 of the screw. Alternatively a hydraulic or pneumatic system could be used in place of motor 24. A chain 28 couples the two screws 23 together to synchronize the raising motion.

Tracks 18a, 18b are, of course, fixed, for example, by welding to the end support 16a and in a similar manner to the opposite end support 16b. The tracks are initially oriented horizontally at their extremities changing to a vertical direction along screws 23.

A channel unit 29 connects the upper portions of the end supports 16a, 16b to provide for greater rigidity and also forms a shield for chain 28. Each structural member 13a, 13b, since they must carry heavy heater modules and span the entire width of the paper 11, is formed as a beam-like torque tube. This is shown as 31b in FIG. 2 with one side of the torque tube being completed by spaced welded plates 32b leaving apertures therebetween. Torque tube 31b thus provides a conduit for the power cables which exit through the spaces between plates 32b.

The outer face of each member 13a, 13b, illustrated as 33b, is contoured or sloped so that the movement, as illustrated in phantom in FIG. 2, of the unit from its operating position to its stowed position will not exceed the actual width, as measured along the direction of movement of the paper, of the entire apparatus 10. Thus, referring to the phantom view 13b' of FIG. 2, the intermediate motion position, the contouring of the outer face of the unit clearly shows how it minimizes interference with the adjacent structure of the paper making machine, for example.

In operation, as illustrated in FIG. 2, when the screw 23a is actuated, the structural member 13b which at its one end which is rotatably pinned by pin 21b on nut 22a is, of course, restricted to movement in a vertical and linear line as determined by screw 23. Thus, movement is from 22a through 22a' and finally to 22a''. This causes the other pivot point of member 13b, that is, 19b to both slide in the associated track 18b and to pivot in that track. The final stowed position, as illustrated by 13b'', thus brings, as illustrated in FIG. 7, the heating elements of each structural member in close proximity to each other to thermally capture the infrared heat of each heater module in its own envelope. In other words, the opposite heater modules are closely spaced side-by-side and have the same boundary with each other. Of course, the heaters would be switched off at this point but their thermal inertia would still produce a great amount of heat which might otherwise be a fire hazard to the web 11 or its surrounding area. When a paper machine malfunctions, the paper sheet is usually cut. This causes scraps of paper to fly about. With the heaters in their stowed, clam shell, position, the heat from the heated surfaces of the modules is thermally captured to minimize the fire hazard.

With the foregoing mechanical arrangement, the speed of retraction relative to the masses being moved is very fast to thus minimize fire hazards.

A typical heater module 15b, is shown in FIG. 4, as it would be mounted to the structural member or frame 13b. The module is mounted to the frame in a modular manner for easy installation and removal. And specifically by the inter-connect unit 36. This unit both provides for the physical retention of the heater module and also for the electrical connection of the heating elements to the electrical cabling 35 which as discussed above may be laid through the conduit formed by the structural member at 31b. The units of FIG. 4 are also shown in phantom in FIG. 2.

Figures 3A, 3B:
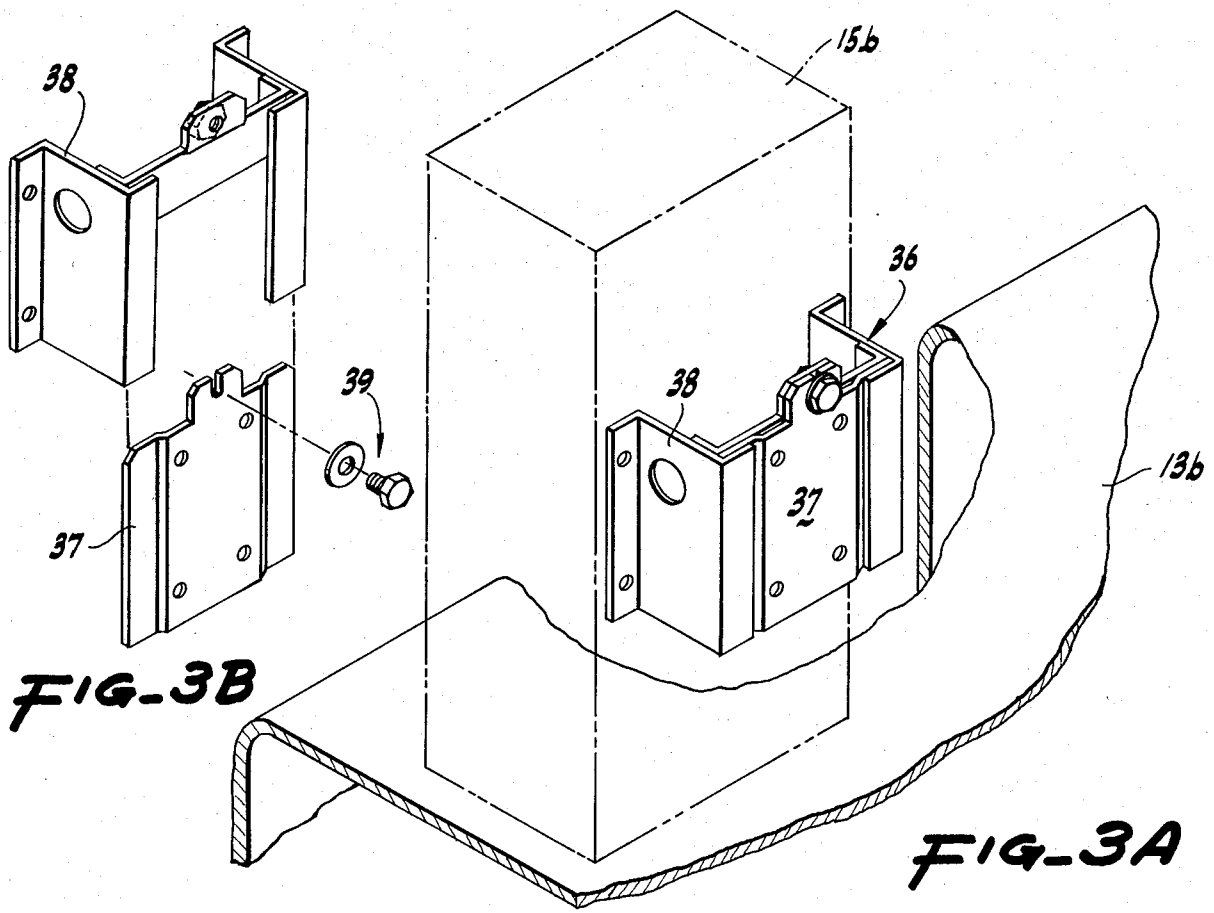
FIG. 3A is a perspective view illustrating the mounting of a heater module.
FIG. 3B is an exploded perspective view of a portion of FIG. 3A.

Referring briefly to FIGS. 3A and 3B, this illustrates the slip-on modular mounting 36 which is formed by a two-part bracket. A first bracket portion 37 in the form of a metal plate is bolted to structural member 13b. The mating U-shaped bracket portion 38 is fixed to the heater module 15b and as indicated in FIG. 3B slips over the unit 37 and is fastened by the bolt washer combination 39. Thus, a single bolt is used to lock each individual heater module to the drying apparatus to thus facilitate easy maintenance and removal.

Now referring back to FIG. 4, from an electrical standpoint, within the unit 38 is an electrical inter-connect shown by female-male connectors 41 which connect the incoming electrical cable 35 to the cable 42 which extends to the heater elements 43 of each heater module.

Figure 5:
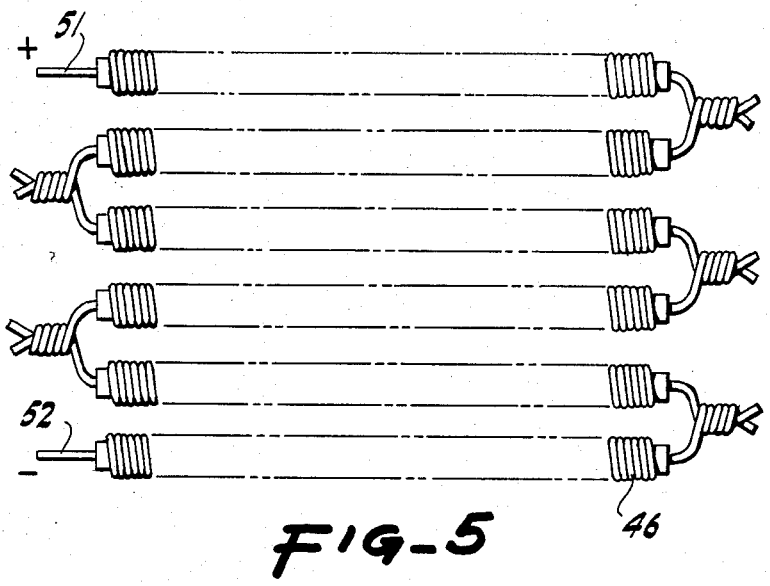
FIG. 5 is a diagrammatic cross-sectional view taken along the line 5—5 of FIG. 4.
Figure 6:
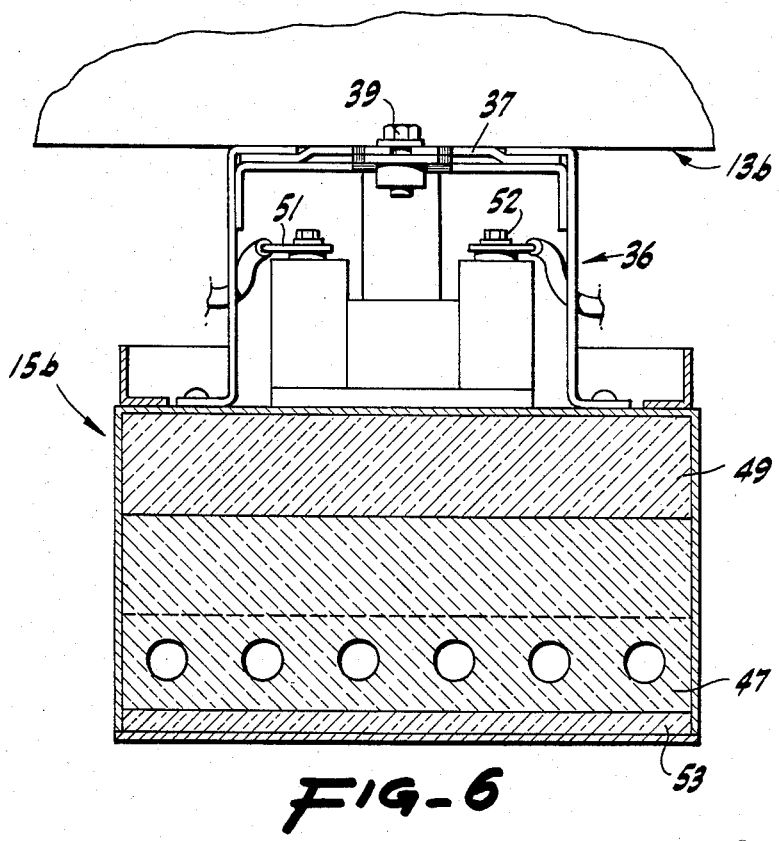
FIG. 6 is a cross-sectional view taken along the line 6—6 of FIG. 4.

The individual heater modules 15b are illustrated in one cross-sectional view of FIG. 4 and another orthogonal view of FIG. 6. Each module has six heater elements 43. They consist of a ceramic tube 44 such as molybdenum oxide which has wrapped around it electrical insulating or resistance wire 46 which most typically would be a ferritic resistance alloy, e.g. KANTHAL (trademark) A1 wire. Ceramic tubes 44 are mounted in ceramic end units 47 and 48. The remainder of the heater unit, as illustrated, is as appropriate ceramic insulation 49. The series connection of the resistance coils 46 series is shown in FIG. 5 resulting in terminal pair 51,52 also illustrated in FIG. 6.

To shield the moving sheet material from actual physical contact with the heater elements, there is a quartz plate 53 covering the entire bottom of the heater module 15b. The quartz plate 53 does not intertere much with the heating effect since it is substantially transparent to infrared radiation. Referring briefly to FIG. 4, and also FIG. 1, on each elongated structural member 13a and 13b, there is an apron 54a, 54b which extends along the bottom of the drying apparatus to shield the surrounding area from infrared radiation and also acts as a protective feature. Mounted at the bottom of this apron 54 is a ceramic fiber tube 56b having internal solid fiber cores 57 which when pinned by fastener 58 to apron 54 provides a protruding end 59 below the general level of the heater module 15. Thus, when the structural members 13a and 13b are moved to their stowed position, as illustrated in FIG. 7, these insulating strips 56 mate together to provide a complete barrier and thermally capture the heat preventing its escape to the surrounding area and the moving paper which is below. In other words, the heat of the heater modules is captured in its own envelope formed by the ceramic strips 56. These are commonly made of, for example, ceramic fiber under the trademark NEXTEL 312. The position of the units 13a'', 13b'' of FIG. 7 would be as shown in phantom in FIG. 2 as 13a,b'': that is, a significant distance above the paper 11.

From a maintenance standpoint, the present invention provides for easy removal of the heater modules because of the one bolt connection. This would normally be done as illustrated in FIG. 2 when the structural members were in the intermediate position 13*b*'. Another advantage of the present invention, is that the structural part of the frame is kept away from the heaters themselves which are hung from the frame to reduce heat build-up and stress and bending from expansion.

Thus, an improved dryer unit for moving sheet material from a moving web has been provided.

What is claimed is:

1. A method of drying a moving web comprising the following steps:

providing across the transverse cross-direction of said web a pair of elongated dryer units each extending from one edge of said web to the other, each having radiation emitting surfaces facing said web and being in close proximity to said web to dry it;

moving said pair of dryer units to a stowed position in which the radiation emitting surfaces of said units which were formerly facing said web are now closely juxtaposed and co-extensive with each other and have the same boundary with each other to form a closed envelope for retaining heat produced by said radiation emitting surfaces whereby the escape of infrared radiation from said drying elements to the surrounding area and direct radiation to other surfaces is prevented to minimize fire hazards.

2. Apparatus for drying a moving web comprising:

a pair of elongated structural members having a length at least as great as said web in a transverse cross-direction and carrying a plurality of side-by-side heater modules for drying said web each of said modules including heater elements forming a radiation emitting surface normally facing and in close proximity to said web;

means for moving said pair of members from an operating position, where heating elements contained in each of said heater modules are facing and in close proximity to said web to dry it, to a stowed position where said pair of members are folded together so that said radiation emitting surfaces are closely juxtaposed and co-extensive with each other and have the same boundary with each other to form a closed envelope for retaining heat produced by said radiation emitting surfaces.

3. Apparatus as in claim 2 where said means for moving include a pair of fixed support means for retaining and moving said structural members at both ends each of said support means including a pair of tracks in which a portion of a respective member is slidable and pivotable, and actuator means connected to another end portion of the members for moving such another end portion along a linear path to slide and pivot said first portion.

4. Apparatus as in claim 2 where an apron portion of each structural member includes a flexible insulating strip which, when in the stowed position, mate with each other to form said closed envelope for retaining the heat of the heater elements.

5. Apparatus as in claim 2 where each heater module is mounted to a structural member by a single fastener for easy removal.

6. Apparatus as in claim 2 where each heater module has a connector means connecting it to its associated elongated structural member and includes means for automatically making electrical connection therebetween.

7. Apparatus as in claim 2 in which the exterior of each elongated structural member is sloped and rounded to minimize interference with adjacent structure during movement from the operating position to the stowed position and vice versa.

8. Apparatus as in claim 2 in which each elongated structural member effectively forms a torque tube to support its own weight and the weight of the associated heater modules across the width of the moving web.

9. Apparatus as in claim 3 where said actuator means for moving such another end portion along the linear path includes a vertical raising screw with a nut which has rotatably pinned to it the other end portions of said elongated members.

10. Apparatus as in claim 3 in which said pair of tracks at each end of said support means are positioned so that their extremities are relatively horizontal changing in direction to a vertical direction to thereby provide said close juxtaposition and folding together of said pair of members.

11. Apparatus as in claim 10 in which said pair of tracks at each end of said support means are positioned so that in said stowed position said heating elements are not only folded together, but are also removed a significant distance from said moving web.

* * * * *